United States Patent [19]

Jennings, Jr. et al.

[11] Patent Number: 5,011,059

[45] Date of Patent: Apr. 30, 1991

[54] DEVICE FOR HOLDING ROLLS OF WRAPPING MATERIAL

[76] Inventors: Harold Jennings, Jr.; Carol A. Jennings, both of 5831 Bristlecone Ct., St. Louis, Mo. 63129

[21] Appl. No.: 556,559

[22] Filed: Jul. 20, 1990

Related U.S. Application Data

[63] Continuation of Ser. No. 246,343, Sep. 19, 1988, abandoned.

[51] Int. Cl.[5] ..... B26F 3/02

[52] U.S. Cl. ..... 225/35; 83/650; 225/47

[58] Field of Search ..... 225/35, 39, 42, 46, 225/47; 83/650

[56] References Cited

U.S. PATENT DOCUMENTS

| | | | |
|---|---|---|---|
| 284,105 | 8/1883 | Westerfield | 225/47 |
| 840,702 | 1/1907 | Maloney | 83/650 |
| 2,456,660 | 12/1948 | Werner | 225/35 |
| 3,281,032 | 10/1966 | Solomon | 225/47 |
| 3,317,099 | 5/1967 | Solomon | 225/42 |

*Primary Examiner*—Hien H. Phan

*Attorney, Agent, or Firm*—Senniger, Powers, Leavitt & Roedel

[57] ABSTRACT

A device for holding a plurality of rolls of wrapping material and for cutting a selected depth of wrapping material pulled from a selected roll, comprising a housing having a front, a back and opposite side walls, and a rack between the side walls of the housing for holding the rolls of wrapping material with the rolls extending generally horizontally between the side walls, each roll being rotatable on the rack about an axis extending longitudinally of the roll. The rack is mounted for rotation relative to the housing on a generally horizontal axis for moving a selected roll or wrapping material into a dispensing position adjacent the front of the housing. A cutter extends generally horizontally at the front of the housing for cutting a length of wrapping material pulled from a selected roll in the dispensing position. A door at the front of the housing is movable between an open position wherein wrapping material may be pulled from a respective roll and cut to length, and a closed position for concealing the rolls from view.

12 Claims, 2 Drawing Sheets

DEVICE FOR HOLDING ROLLS OF WRAPPING MATERIAL

This is a continuation of application Ser. No. 246,343, filed Sept. 19, 1988, now abandoned.

BACKGROUND OF THE INVENTION

This invention relates generally to apparatus for handling rolls of sheet material and, more particularly, to a device which is useful for holding a plurality of rolls of wrapping material and for cutting selected lengths of wrapping material from the rolls.

Most households use various sorts of wrapping material (e.g., aluminum foil, cellophane, waxed paper) which are typically sold as rolls in elongate cardboard cartons, one roll per carton, with each carton having a cutting edge for cutting the sheet material to selected length. These cartons are bulky and unattractive and thus are usually stored away from view, making access and use inconvenient.

Reference may be made to the following patents for devices generally in the field of this invention: 3,905,532, 4,222,621, 2,336,496, 3,714,725, 2,954,823 and 940,236.

SUMMARY OF THE INVENTION

Among the several objects of this invention may be noted the provision of a device for neatly and compactly holding a plurality of rolls of wrapping material and for enabling a selected length of material to be pulled from a selected roll and then cut; the provision of such a device which is attractive in appearance and which can be closed to conceal the rolls when not in use; the provision of such a device where the rolls are quickly and easily replaceable; the provision of such a device which can be mounted on the underside of an overhanging cabinet for convenient access and use; the provision of such a device which is rugged and durable and yet relatively inexpensive to fabricate; and the provision of such a device which is easy to use and safe and reliable in operation.

In general, a device of the present invention comprises a housing having a front, a back and opposite side walls, a rack between the side walls of the housing for holding said plurality of rolls of wrapping material with the rolls extending generally horizontally between the side walls, each roll being rotatable on the rack about an axis extending longitudinally of the roll, means mounting the rack for rotation of the rack relative to the housing on a generally horizontal axis, the rack being rotatable on said axis for moving a selected roll of wrapping material into a dispensing position adjacent the front of the housing, means for locking the rack against rotation relative to the housing when a selected roll is in said dispensing position, cutting means extending generally horizontally at the front of the housing for cutting a length of wrapping material pulled from a selected roll in said dispensing position, and a door at the front of the housing movable between an open position wherein wrapping material may be pulled from a respective roll and cut to length, and a closed position for concealing the rolls from view.

Other objects and features will be in part apparent and in part pointed out hereinafter.

BRIEF DESCRIPTION OF THE DRAWINGS

Corresponding numerals indicate corresponding parts throughout the several view of the drawings.

DESCRIPTION OF THE PREFERRED EMBODIMENT

Figure 1:
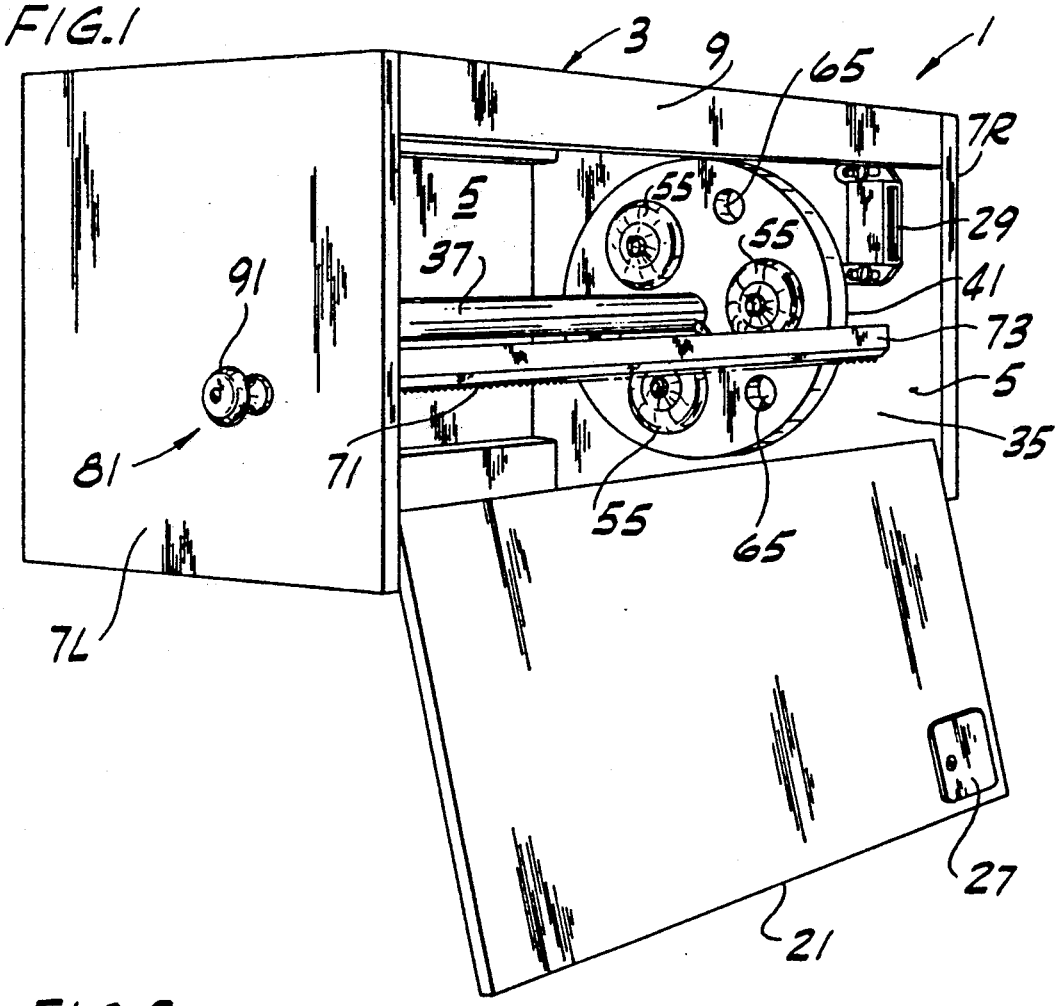
FIG. 1 is a perspective of a device of the present invention, for holding a plurality of rolls of wrapping material, a door of the device being shown open to reveal the interior of the device.

Referring now to the drawings, a device of the Present invention is indicated in its entirety by the reference numeral 1. As described hereinafter, the device is adapted for holding a plurality of rolls (e.g., three rolls R1, R2 and R3) of wrapping material and for cutting lengths of material pulled from the rolls to selected length.

Figure 2:
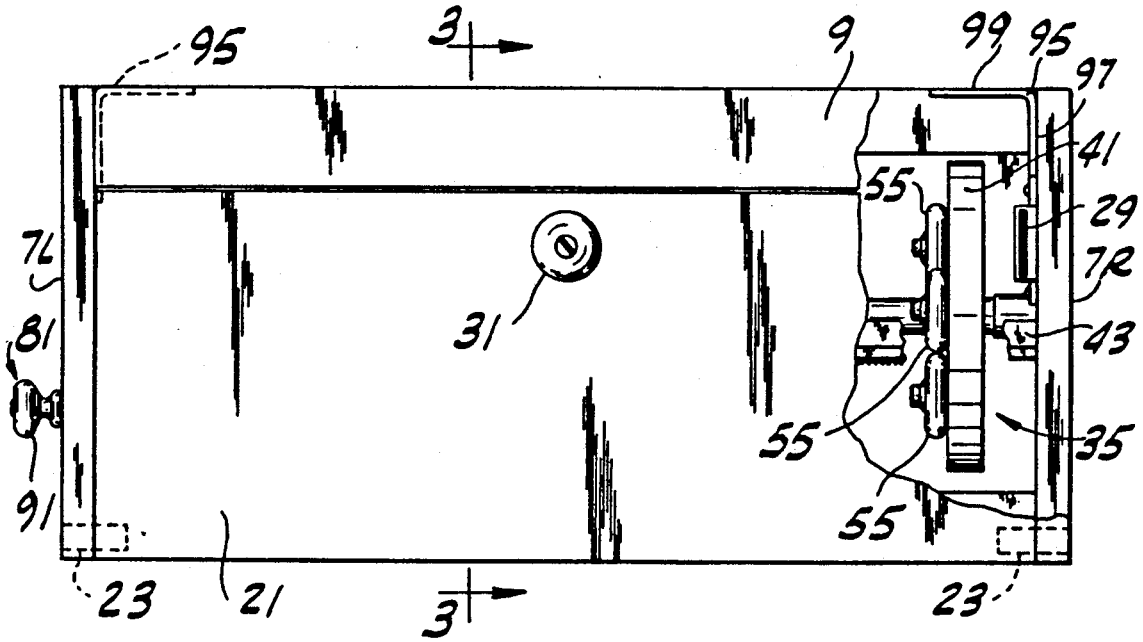
FIG. 2 is a front elevation of the device showing the door closed and with portions broken away to illustrate details.

The device 1 comprises a housing generally designated 3 having a front 5, a back 5 and spaced apart generally parallel side walls 7L, 7R. The side walls are connected by a top front frame member 9 and a rear frame member spaced apart to provide a substantially open top 13 for the housing, and a bottom rear frame member 15 spaced below the top rear frame member 11 to provide a substantially open back 5 for the housing. The bottom 17 of the housing is also substantially open. A rectangular door 21 is pivoted at 23 on the side walls 7L, 7R at the front of the housing for swinging on a generally horizontal axis between a closed position (FIG. 2) in which the door is received between the side walls below the top front frame member 9 to close the front of the housing, and an open position (FIG. 1) in which it is swung down for access to the inside of the housing. Means comprising a metal plate 27 attached to the inside of the door and a magnet 29 attached to one side wall 7R on the inside of the housing 3 constitutes means for releasably securing the door in its closed position. Other mechanisms may be used for securing the door in position. A knob 31 is provided on the front of the door 21 for facilitating opening and closing the door.

Indicated generally at 35 in the housing 3 is a rack for holding the rolls R1, R2 and R3 of wrapping material with the rolls extending generally horizontally in side-to-side direction with respect to the housing. As shown, the rack 35 comprises a horizontal shaft 37 of circular cross section extending in side-to-side direction with respect to the housing and a pair of holding members in the form of solid discs 39, 41 concentrically mounted on the shaft adjacent opposite ends thereof and relatively close to the side walls 7L, 7R of the housing. The ends of the shaft 37 project endwise beyond the discs 39, 41 and are journalled in semi-cylindric bearing members 43 secured to the inside faces of the side walls of the housing generally centrally of the side walls, the arrangement being such that the rack 35 and the rolls R1, R2, R3 held thereby are rotatable relative to the housing on a horizontal axis A1 corresponding to the central longitudinal axis of the shaft. The bearing members 43 are open at their tops so that the ends of the shaft 37 maybe lifted from the bearing members for removal of the rack from the housing. One of the discs 41 has a friction fit on the shaft 37 and is slidably removable from the shaft for placement or replacement of one or more rolls on the rack, as will appear. A key 51 on the shaft receivable in a recess forming a keyway 53 in the inside face of the removable disc constitutes means for preventing relative rotation between the disc and the shaft when the disc is in place on the shaft. The other disc 39 is permanently affixed to the shaft.

The discs 39, 41 have circular trunnions 55 thereon constituting means for rotatably mounting the rolls R1, R2 and R3 on the rack 35 so that each roll is rotatable about its central longitudinal axis A2 as material is Pulled from the roll. Two trunnions 55, one per disc 39, are provided for each roll. The trunnions are spaced at equal intervals around the inside face of each disc (e.g., at 120 degree intervals for three rolls) and are affixed to the discs by pins indicated at 61. The trunnions 55 are sized to fit inside the ends of the rolls, the fit being relatively loose so that the rolls are able to rotate freely on the trunnions. To further ease rotation of the rolls, the trunnions are free to turn on their respective pins. For reasons which will become apparent, each disc 39, 41 has a plurality of openings 65 therein (one for each roll) spaced at equal angular intervals around the disc midway between the trunnions.

Figure 3:
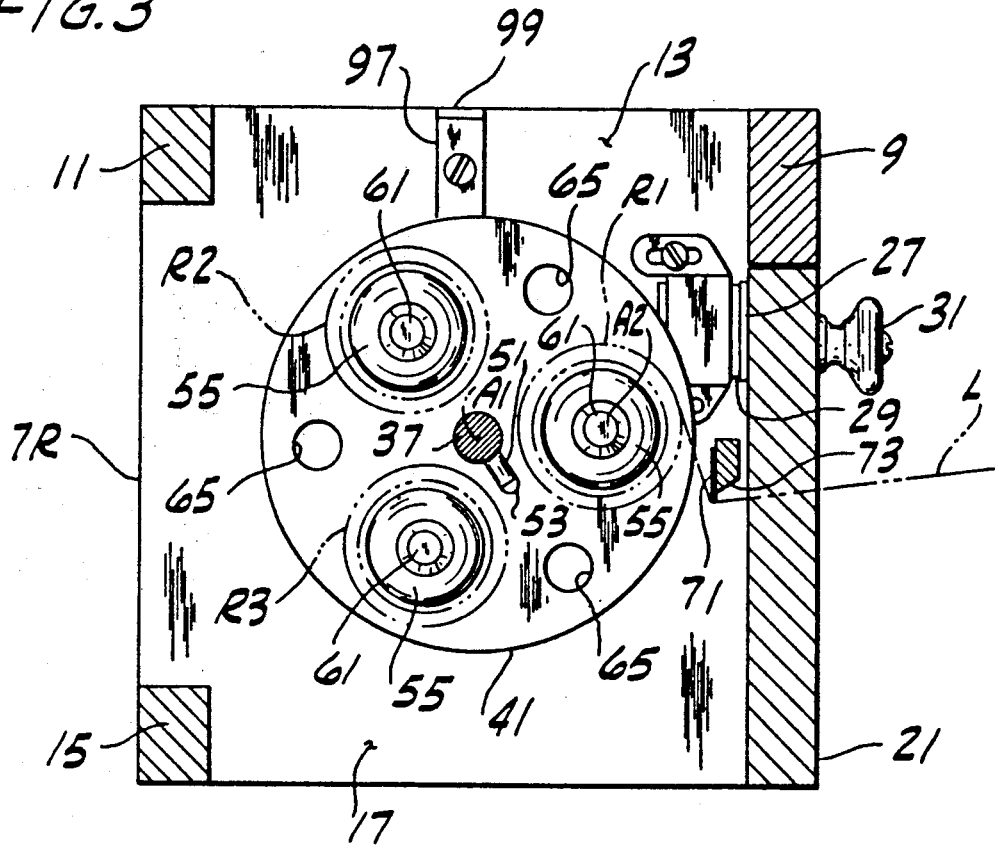
FIG. 3 is a vertical section on line 3—3 of FIG. 2.

In accordance with the present invention, the rack is rotatable on axis A1 for moving a selected roll of wrapping material on the rack 35 into a dispensing position adjacent the front of the housing 3 where the axis A2 of the roll is disposed at a level about the same as that of axis A1. Roll R1 is shown in the stated dispensing position in FIG. 3. In this position, a length L of wrapping material may be pulled from the selected roll (as the roll turns on its respective trunnions 55) and then cut by means of a blade 71 mounted on a horizontal bar 73 extending between the side walls 7L, 7R of the housing 3 immediately forward of the discs 39, 41. The blade 71 has a downwardly directed saw-tooth cutting edge which runs the full length of the rolls and which is at a level below that of the axis A2 of a roll in the stated dispensing position.

Figure 4:
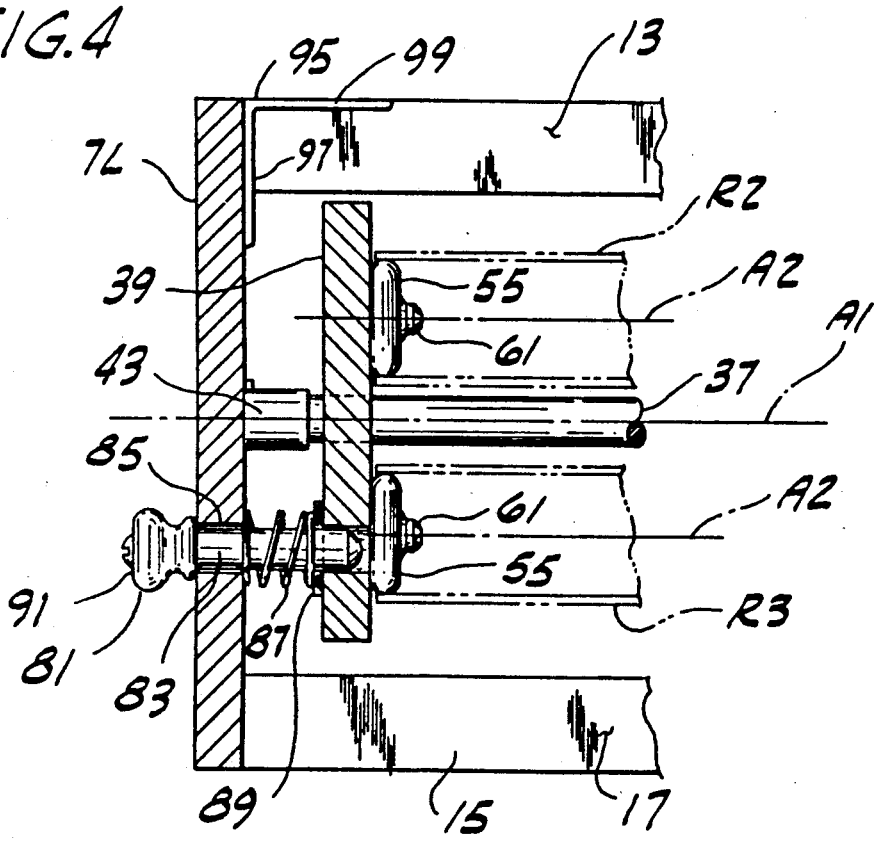
FIG. 4 is a sectional view showing a detent mechanism.

A detent indicated generally at 81 on a side wall 7L of the housing 3 is engageable with one of the discs 39 of the rack 35 for locking the rack against rotation relative to the housing when a selected roll (e.g., roll R1) is in the stated dispensing position. More specifically, the detent 81 comprises a locking pin 83 mounted for axial sliding movement in a bore 85 in side wall 7L of the housing between an extended position (FIG. 4) in which the pin is receivable in one of the openings 65 in the adjacent disc 39 to lock the rack against rotation, and a retracted position (not shown) in which the pin is removed from the opening for allowing the rack to be rotated to bring a different roll into the stated dispensing position. A coil spring 87 reacting at one end against the inside face of the side wall 7L and at its other end against a stop 89 on the locking pin biases the locking pin toward its extended position. A knob 91 on the pin 83 on the outside of the housing provides for easy retraction of the pin. It will be noted that each disc 39, 41 has openings 65 therein. This is so that the rack 35 may be placed in the housing with either disc adjacent the side wall 7L with the detent 81.

To facilitate mounting the housing 3 on the underside of an overhanging cabinet, for example, a pair of mounting brackets, each designated 95, are affixed to the side walls 7L, 7R of the housing adjacent the top 13 of the housing. Each bracket is L-shaped, having a vertical leg 97 affixed (e.g., screwed) to a respective side wall, and a horizontal leg 99 projecting inwardly into the housing at a level the same as the top of the housing so that the housing fits flush against the surface on which it is being mounted.

The housing and rack may be of any suitable material such as wood or plastic.

To load or reload the rack 35 with rolls R1, R2, R3 of wrapping material, the rack must first be removed from the housing 3, which may be accomplished by retracting the locking pin 83, lifting the rack off the bearing members 43, and then lowering the rack through the open bottom 17 of the housing. The removable disc 41 is then pulled off the shaft 37, the roll or rolls to be loaded placed with one of their ends on the trunnions 55 on the permanently affixed disc 39, and the removable disc 41 replaced on the shaft and moved to a position wherein the key 51 on the shaft is received in the keyway 53 in the disc and the other ends of the rolls are properly positioned on the trunnions 55 on the removable disc 41. The rack is then placed back in the housing while pulling the locking pin 83 to its retracted position.

To use the device of this invention, the locking pin 83 of detent 81 is pulled to its retracted position, the rack 35 rotated to move a selected roll to the stated dispensing position, and the locking pin released to move to its extended position to lock the rack against further rotation. Wrapping material may then be pulled from the selected roll under and past the blade 71 until the desired length of material is obtained whereupon the material is pulled sharply upwardly against the cutting edge of the blade to sever it. It will be noted in this regard that the roll should preferably be oriented on the roll so that the material is pulled under the blade from the top of the roll rather than the bottom of the roll. To use a different roll, the locking pin 83 is retracted, the rack rotated (preferably in a counterclockwise direction as viewed in FIG. 3 to prevent the rolls from unwinding) to bring the desired roll (e.g., roll R3) into dispensing position, and the locking pin released.

The parts of the device 1 of the present invention may be made from any suitable commercially available material such as wood, plastic or metal. Also, it will be understood that the dimensions of the device may vary depending on the size, length and number of rolls being handled.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A device for holding a plurality of rolls of wrapping material and for cutting a selected length of wrapping material pulled from a selected roll, comprising:

a housing having a front, a back and opposite side walls;

a rack between the side walls of the housing for holding said plurality of rolls of wrapping material with the rolls extending generally horizontally between the side walls, each roll being rotatable on the rack about an axis extending longitudinally of the roll;

bearings attached to the side walls of the housing mounting the rack for rotation of the rack relative to the housing on a generally horizontal axis, said rack being rotatable on said axis for moving a selected roll of wrapping material into a dispensing position adjacent the front of the housing;

means for locking the rack against rotation relative to the housing when a selected roll is in said dispensing position;

cutting means extending generally horizontally at the front of the housing for cutting a length of wrapping material pulled from a selected roll in said dispensing position; and a door at the front of the housing movable between an open position wherein wrapping material may be pulled from a respective roll and cut to length, and a closed position for concealing said rolls from view, said rack comprising a shaft having opposite ends rotatable in said bearings, a pair of support members on the shaft adjacent opposite ends of the shaft, and trunnions on the support members receivable in the ends of the rolls to enable rotation of the rolls on their respective axes, said shaft being removable from said bearings without detaching the bearings from the side walls of the housing to enable the rack to be readily removed from the housing, and at least one of said support members being removable from the shaft when the rack is removed from the housing to permit rolls to be mounted on and dismounted from said trunnions.

2. A device as set forth in claim 1 wherein said locking means also functions to maintain the shaft in said bearings.

3. A device as set forth in claim 2 wherein said locking means comprises a detent on one of the side walls of the housing engageable with one of said support members of the rack.

4. A device as set forth in claim 3 wherein said detent comprises a locking pin mounted for axial movement between an extended position in which the pin is receivable in an opening in said support member and a retracted position in which the pin is removed from said opening for allowing the rack to be rotated, and spring means biasing said detent toward said extended position.

5. A device as set forth in claim 4 wherein said door is pivoted on the side walls of the housing for swinging between its open and closed positions on a generally horizontal axis.

6. A device as set forth in claim 5 wherein said door is pivoted adjacent the bottom of the side walls of the housing for swinging from a closed position down to an open position and from an open position up to a closed position, and means for releasable securing the door in its closed position.

7. A device as set forth in claim 1 wherein said trunnions on said support members are freely rotatable relative to the support members.

8. A device as set forth in claim 7 wherein said support members comprise a pair of discs which are unconnected except by said shaft.

9. A device as set forth in claim 1 wherein said cutting means comprises a blade having a downwardly facing cutting edge extending in generally horizontal position between the side walls of the housing immediately forward of the rack.

10. A device as set forth in claim 9 wherein said cutting edge is at a level slightly below the axis of rotation of the rack.

11. A device as set forth in claim 1 further comprising means for mounting said housing on the underside of a cabinet.

12. A device for holding a plurality of rolls of wrapping material and for cutting a selected length of wrapping material pulled from a selected roll, comprising:

a housing having a front, a back and opposite side walls;

a rack between the side walls of the housing for holding said plurality of rolls of wrapping material with the rolls extending generally horizontally between the side walls, each roll being rotatable on the rack about an axis extending longitudinally of the roll;

bearings on the side walls of the housing mounting the rack for rotation of the rack relative to the housing on a generally horizontal axis, said rack being rotatable on said axis for moving a selected roll of wrapping material into a dispensing position adjacent the front of the housing;

means for locking the rack against rotation relative to the housing when a selected roll is in said dispensing position;

cutting means extending generally horizontally at the front of the housing for cutting a length of wrapping material pulled from a selected roll in said dispensing position;

a door at the front of the housing movable between an open position wherein wrapping material may be pulled from a respective roll and cut to length, and a closed position for concealing said rolls from view, said rack comprising a shaft having opposite ends rotatable in said bearings, a pair of support members on the shaft adjacent opposite ends of the shaft, and trunnions on the support members receivable in the ends of the rolls to enable rotation of the rolls on their respective axes, said shaft being removable from said bearings to enable the rack to be removed from the housing, and at least one of said support members being removable from the shaft when the rack is removed from the housing to permit rolls to be mounted on and dismounted from said trunnions; and a key on the shaft receivable in a keyway on said removable support member for preventing relative rotation between the shaft and the removable support member when the removable support member is on the shaft.

* * * * *